US012385492B1

(12) United States Patent
Chen et al.

(10) Patent No.: US 12,385,492 B1
(45) Date of Patent: Aug. 12, 2025

(54) COMPOSITE FAN

(71) Applicant: Yen Sun Technology Corp., Kaohsiung (TW)

(72) Inventors: Graham Chen, Kaohsiung (TW); Chang-Sung Wang, Kaohsiung (TW); Mei-Chih Fang, Kaohsiung (TW); Chia-Hsuan Kuo, Kaohsiung (TW)

(73) Assignee: Yen Sun Technology Corp., Kaohsiung (TW)

( * ) Notice: Subject to any disclaimer, the term of this patent is extended or adjusted under 35 U.S.C. 154(b) by 0 days.

(21) Appl. No.: 18/769,808

(22) Filed: Jul. 11, 2024

(30) Foreign Application Priority Data

Apr. 23, 2024 (TW) ..... 113115083

(51) Int. Cl.

| | |
|---|---|
| ***F04D 17/16*** | (2006.01) |
| ***F04D 29/28*** | (2006.01) |
| ***F04D 29/38*** | (2006.01) |
| ***F04D 29/42*** | (2006.01) |

(52) U.S. Cl.
CPC ..... *F04D 17/16* (2013.01); *F04D 29/281* (2013.01); *F04D 29/384* (2013.01); *F04D 29/4226* (2013.01)

(58) Field of Classification Search
CPC ..... F04D 17/16; F04D 29/181; F04D 29/183; F04D 29/281; F04D 29/384; F04D 29/4226; H05K 7/20136; H05K 7/20172
See application file for complete search history.

(56) References Cited

U.S. PATENT DOCUMENTS

| | | | | |
|---|---|---|---|---|
| 5,484,262 | A * | 1/1996 | Thomas | H01L 23/467 165/125 |
| 5,879,141 | A * | 3/1999 | Yokozawa | F04D 25/0646 415/203 |
| 6,179,561 | B1 * | 1/2001 | Horng | F04D 29/602 361/679.48 |
| 6,710,486 | B1 * | 3/2004 | Horng | F04D 29/667 310/59 |
| 6,779,992 | B2 * | 8/2004 | Lei | F04D 29/023 416/212 R |
| 7,063,504 | B2 * | 6/2006 | Huang | F04D 29/526 415/165 |
| 7,223,068 | B2 * | 5/2007 | Horng | H05K 7/20172 415/208.5 |
| 7,584,780 | B1 * | 9/2009 | Lemont | H01L 23/467 165/125 |
| 8,068,339 | B2 * | 11/2011 | Kayama | F04D 29/384 361/679.48 |
| 8,740,562 | B2 * | 6/2014 | Takemoto | F04D 29/541 415/220 |

(Continued)

*Primary Examiner* — Brian P Wolcott
(74) *Attorney, Agent, or Firm* — MUNCY, GEISSLER, OLDS & LOWE, P.C.

(57) ABSTRACT

A composite fan includes an outer frame, a hub body pivotably mounted to the outer frame, and a plurality of fan blades extending outwardly from the hub body. The outer frame includes a main frame body and an outer cover. The main frame body defines an air outlet opening in an axial direction and a plurality of air inlets opening radially. The outer cover is disposed on the main frame body and the outer cover and the main frame body are arranged in the axial direction, such that air is radially introduced into the composite fan through the air inlets and discharged through the air outlet in the axial direction.

5 Claims, 7 Drawing Sheets

(56) References Cited

U.S. PATENT DOCUMENTS

| | | | | |
|---|---|---|---|---|
| 8,882,455 | B2 * | 11/2014 | Takemoto | F04D 29/526<br>415/186 |
| 8,953,315 | B2 * | 2/2015 | Takemoto | F04D 29/582<br>361/679.48 |
| 2005/0281692 | A1 * | 12/2005 | Horng | F04D 29/384<br>417/423.3 |

* cited by examiner

COMPOSITE FAN

CROSS-REFERENCE TO RELATED APPLICATION

This application claims priority to Taiwanese Invention patent application No. 113115083, filed on Apr. 23, 2024, the entire disclosure of which is incorporated by reference herein.

FIELD

The disclosure relates to a composite fan, and more particularly to a composite fan for introducing air radially therein and discharging air in an axial direction.

BACKGROUND

Referring to FIGS. 1 and 2, a conventional axial fan is disposed in a frame body (not shown), and includes a hub body 11 pivotably mounted to the frame body, and a plurality of fan blades 12 extending outwardly from a peripheral surface of the hub body 11. Each of the fan blades 12 has a first inner end point 121 connected to the hub body 11, a first outer end point 122 located radially and outwardly of the first inner end point 121 and higher than the first inner end point 121, a second inner end point 123 connected to the hub body 11 and located lower than the first inner end point 121, and a second outer end point 124 located radially and outwardly of the second inner end point 123. For each of the fan blades 12, the first inner end point 121, the first outer end point 122, the second inner end point 123, and the second outer end point 124 cooperatively define a profile of the fan blade 12, which is beneficial to guide air to flow axially.

During operation of the conventional axial fan, air axially flows into the conventional axial fan from a rear of the hub body 11 (in a direction indicated by an arrow (a) in FIG. 2), i.e., from one side of the hub body 11 adjacent to the first inner end points 121 and the first outer end points 122, and discharges outwardly of the conventional axial fan toward a front of the hub body 11 (in a direction indicated by an arrow (b) in FIG. 2), i.e., toward another side of the hub body 11 adjacent to the second inner end points 123 and the second outer end points 124. Although the conventional axial fan provides an airflow greater than that provided by a centrifugal fan, and is useful when being applied to mechanical devices or electronic products that are relatively large, it is necessary to provide reserve spaces that are respectively upstream of and downstream of the conventional axial fan to facilitate air flowing into and out of the conventional axial fan, and an opening that is in the housing and that is in spatial communication with the external environment for ensuring air flowing smoothly into and out of the conventional axial fan. Consequently, the conventional axial fan may occupy a relatively large volume and is not suitable to be mounted in a relatively small space, such as a car seat.

SUMMARY

Therefore, an object of the disclosure is to provide a composite fan that can alleviate at least one of the drawbacks of the prior art.

According to the disclosure, a composite fan adapted for radially introducing air therein and discharging air in an axial direction is provided. The composite fan includes an outer frame, a hub body, and a plurality of fan blades. The outer frame includes a main frame body and an outer cover.

The main frame body defines an inner space that is in the main frame body, an air outlet that opens in the axial direction and that is in spatial communication with the inner space, and a plurality of air inlets that open radially and that are in spatial communication with the air outlet and the inner space. The outer cover covers the main frame body, and the outer cover and the main frame body are arranged in the axial direction. The hub body is pivotably mounted to the outer frame and is disposed in the inner space. A rotational axis of the hub body is parallel to the axial direction. The fan blades extend outwardly from the hub body. Each of the fan blades includes a first inner end point that is connected to the hub body, a second inner end point that is connected to the hub body and that is spaced apart from the first inner end point in the axial direction, a first outer end point that is located radially and outwardly of the first inner end point and that is located between the first inner end point and the second inner end point in the axial direction, and a second outer end point that is located radially and outwardly of the second inner end point. For each of the fan blades, the first inner end point, the second inner end point, the first outer end point, and the second outer end point cooperatively define a profile of the fan blade. The first inner end point is distal from the air outlet in the axial direction relative to the second inner end point. The first outer end point is distal from the air outlet in the axial direction relative to the second outer end point.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
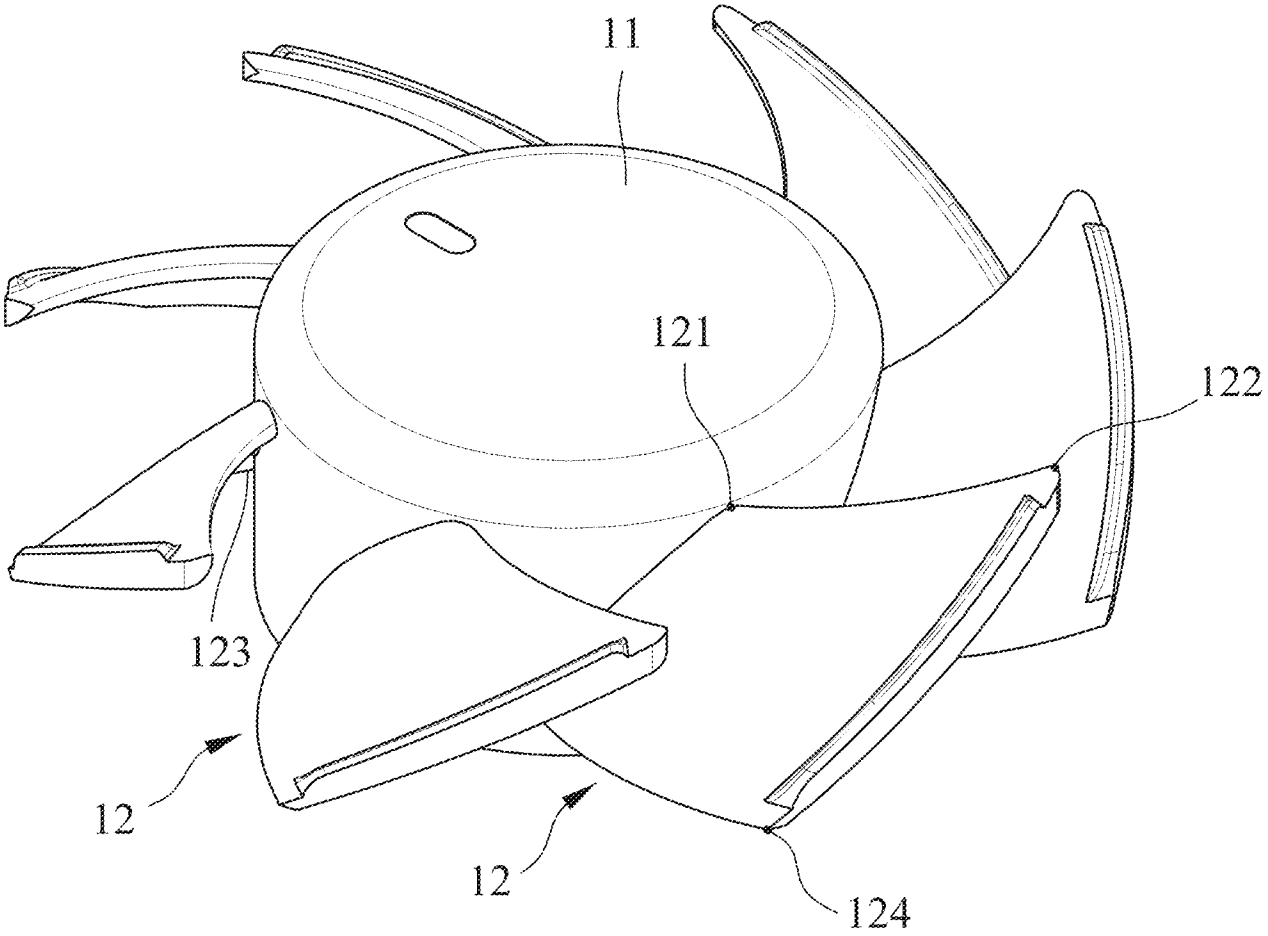
FIG. 1 PRIOR ART
FIG. 1 is a perspective view illustrating a conventional axial fan.
Figure 2:
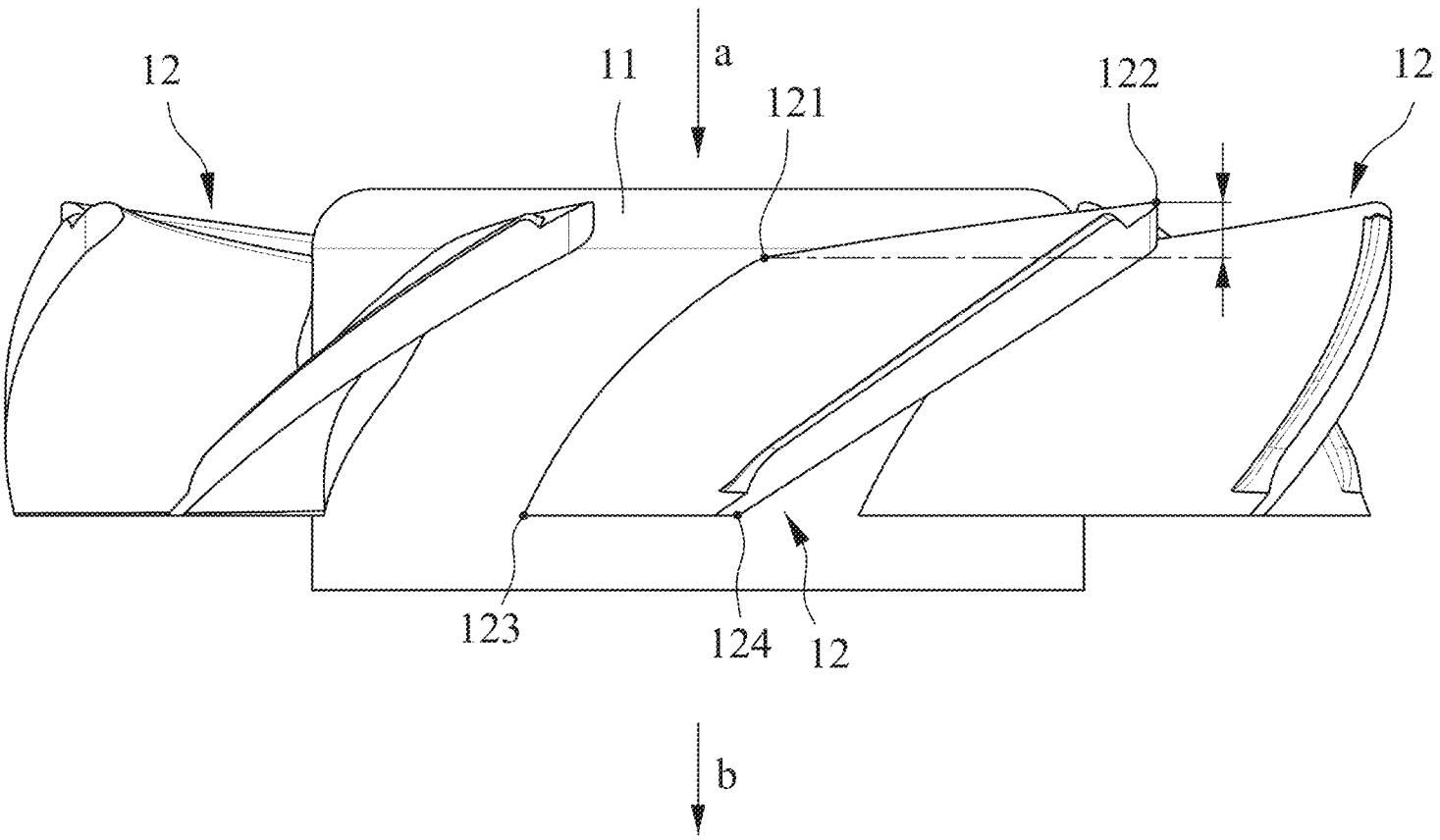
FIG. 2 PRIOR ART
FIG. 2 is a side view illustrating a structure of a plurality of fan blades of the conventional axial fan of FIG. 1.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 3:
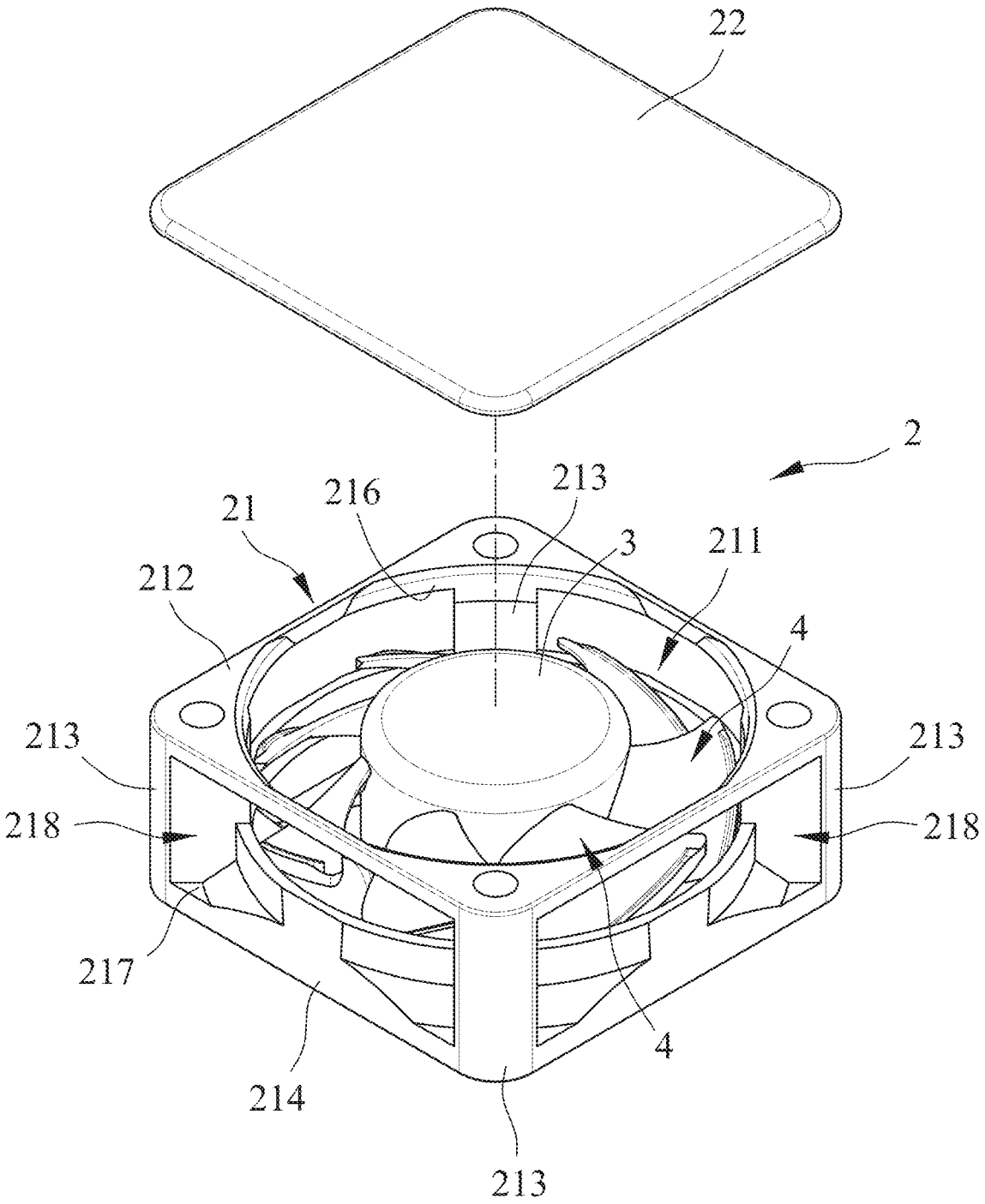
FIG. 3 is a partly exploded perspective view of an embodiment of a composite fan according to the present disclosure.
Figure 4:
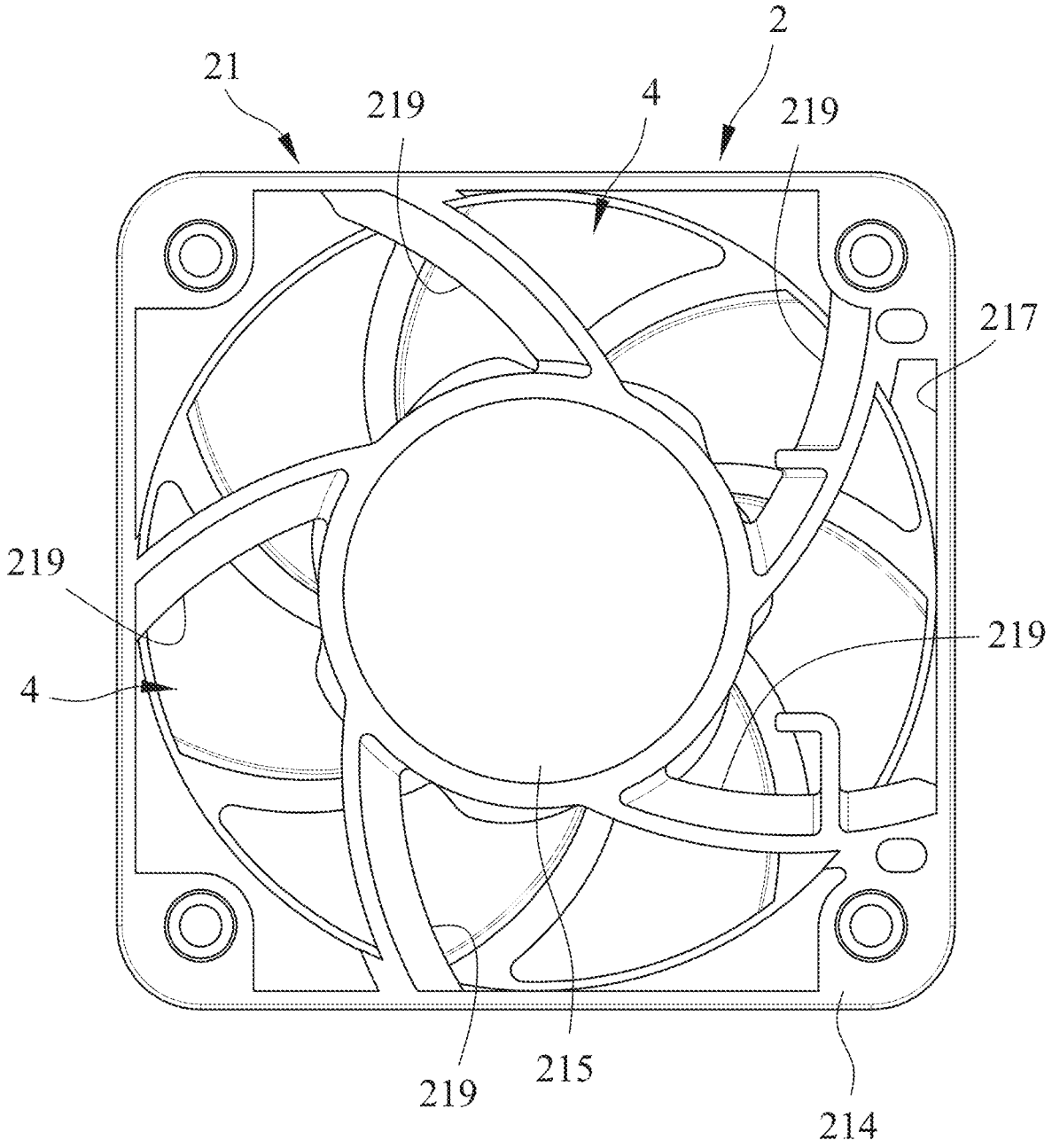
FIG. 4 is a bottom view of the embodiment.
Figure 5:
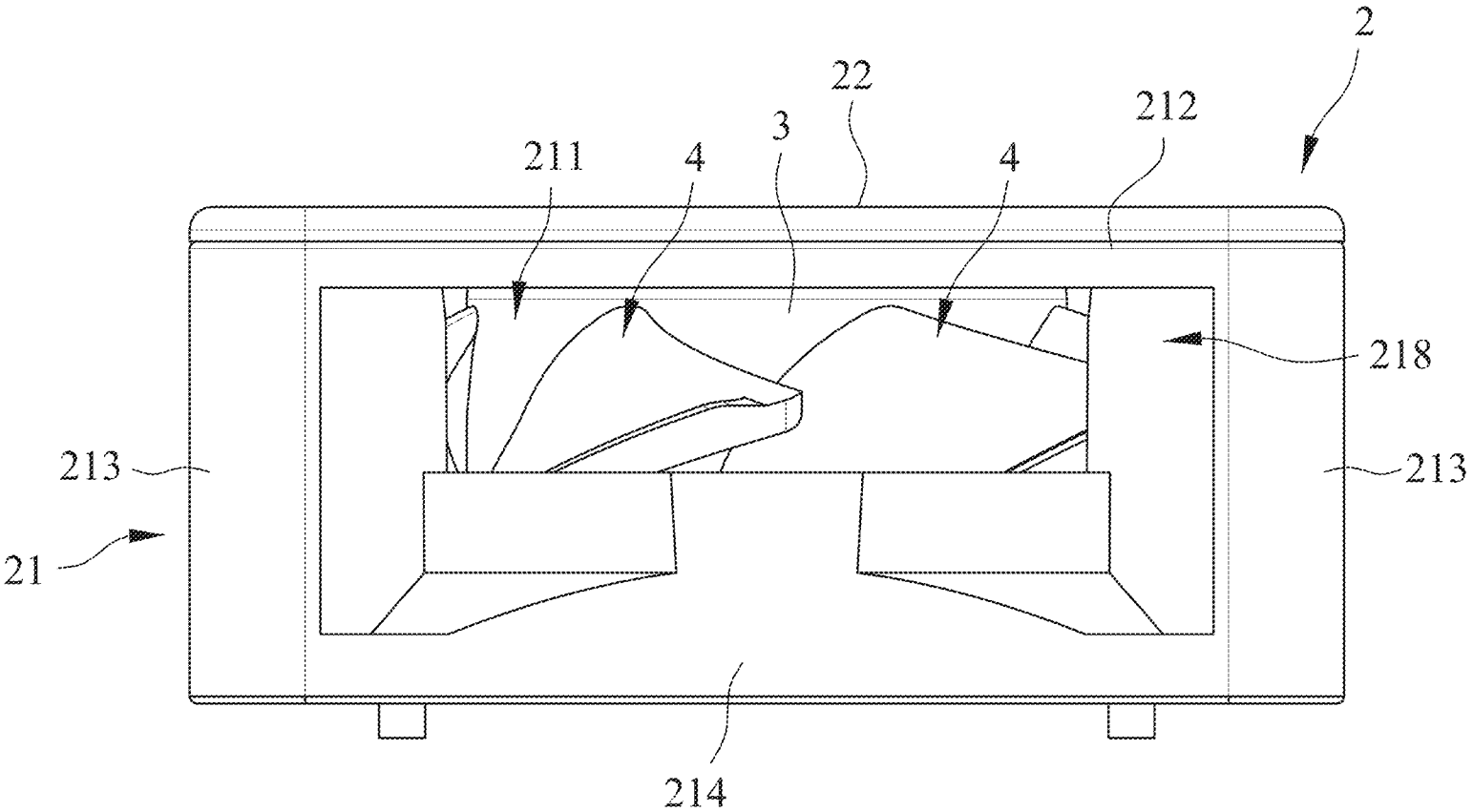
FIG. 5 is an assembled side view of the embodiment.

Referring to FIGS. 3, 4, and 5, an embodiment of a composite fan according to the present disclosure is adapted for introducing air radially therein and discharging air in an axial direction. The composite fan includes an outer frame 2, a hub body 3, and a plurality of fan blades 4. The hub body 3 is pivotably mounted to the outer frame 2 and is rotatable relative to the outer frame 2. The fan blades 4 are annularly disposed on an outer peripheral surface of the hub body 3 and are equidistantly and angularly spaced apart from each other.

The outer frame 2 includes a main frame body 21 and an outer cover 22 covering the main frame body 21. The outer cover 22 and the main frame body 21 are arranged in the axial direction. The main frame body 21 defines an inner space 211, an air outlet 217, and a plurality of air inlets 218. The main frame body 21 has an annular frame portion 212, a plurality of side pillar portions 213, a connecting frame portion 214, and a seat frame portion 215 (see FIG. 4). The annular frame portion 212 defines an opening 216 opening in the axial direction and in spatial communication with the inner space 211. In this embodiment, the annular frame portion 212 has a substantially rectangular outer surface and a circular inner surface and the structure of the annular frame portion 212 may be modified and is not limited hereto. The side pillar portions 213 extend from the annular frame portion 212 in the axial direction, and are annularly disposed and spaced apart from each other. In this embodiment, a number of the side pillar portions 213 is four. The connecting frame portion 214 is connected to the side pillar portions 213, and defines the air outlet 217 that is spaced apart from the opening 216 in the axial direction and that is in spatial communication with the inner space 211. The seat frame portion 215 is connected to the connecting frame portion 214 and is disposed in the air outlet 217. The annular frame portion 212 has a central axis that is parallel to the axial direction. The connecting frame portion 214 has a central axis that is parallel to the axial direction. Any two adjacent ones of the side pillar portions 213, a segment of the annular frame portion 212, and a segment of the connecting frame portion 214 cooperatively define each of the air inlets 218 that opens radially and that is perpendicular to the axial direction. The air inlets 218 are in spatial communication with the inner space 211 and the air outlet 217. The seat frame portion 215 has a disc-shaped central portion and five curved portions extending outwardly and arcuately from a periphery of the central portion. The five curved portions cooperate with the central portion to divide the air outlet 217 into five air outlet slots 219 that are in spatial communication with the inner space 211. That is to say, two adjacent ones of the curved portions define one of the air outlet slots 219 therebetween. It should be noted that the configurations of the seat frame portion 215 and the air outlet slots 219 may be modified according to actual requirements and are not limited to the specific structure described herein. The outer cover 22 may be fixed to the annular frame portion 212 through fastening means such as screws, mortises and tenons, and adhesive. The outer cover 22 covers an outer side of the opening 216 that is opposite to the hub body 3 in the axial direction to close the opening 216.

Figure 6:
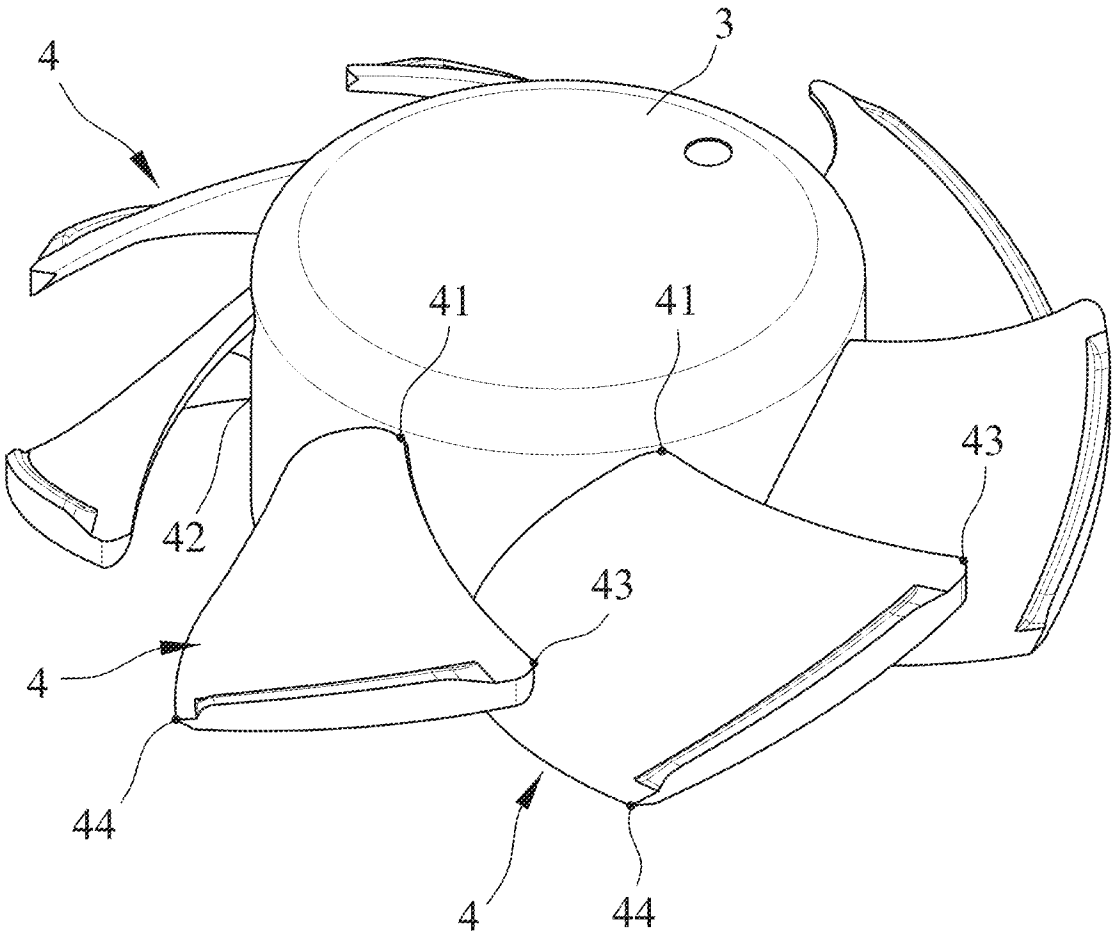
FIG. 6 is a perspective view illustrating a hub body and a plurality of fan blades of the embodiment.
Figure 7:
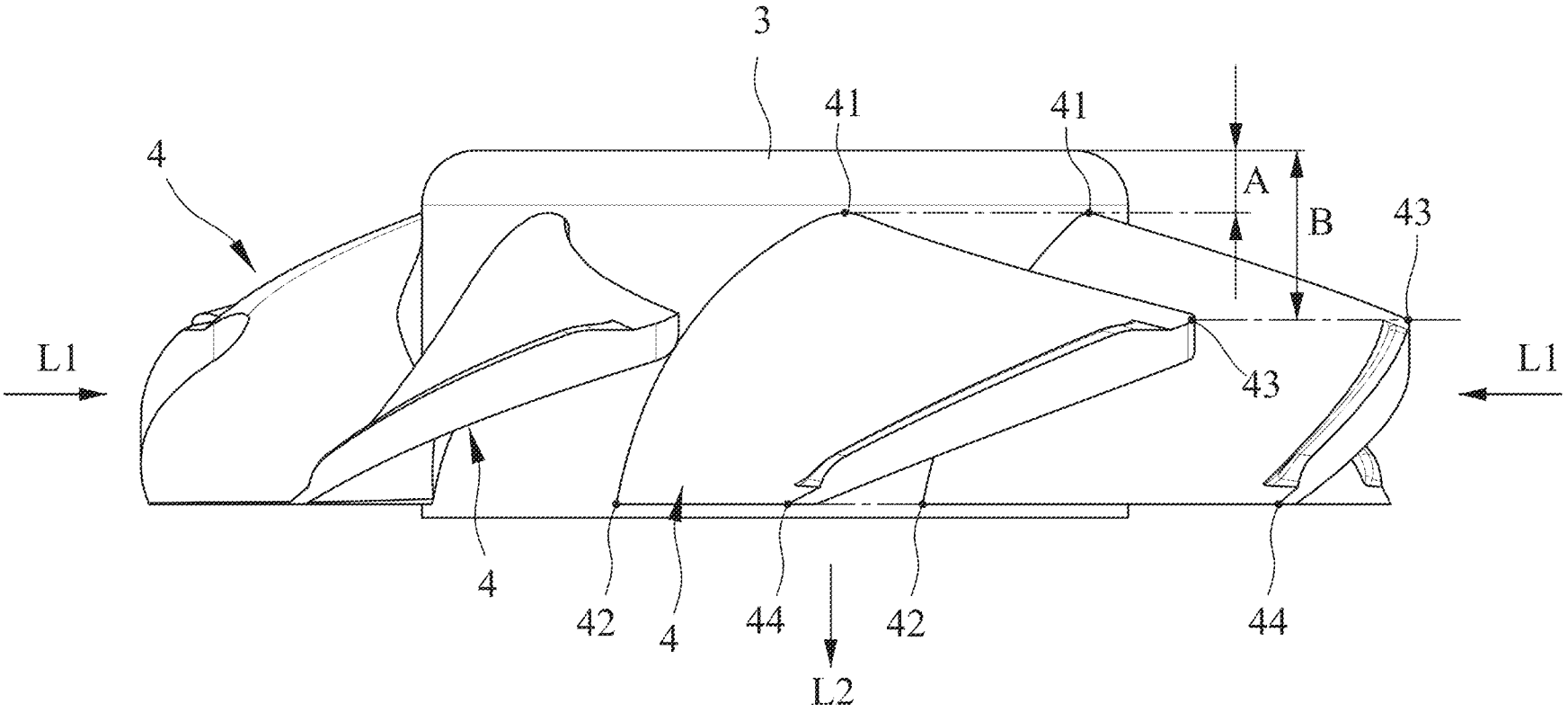
FIG. 7 is a side view illustrating a structure of the fan blades of the embodiment.

Referring to FIGS. 4, 6, and 7, the hub body 3 is pivotably disposed on the seat frame portion 215 and is disposed in the inner space 211 (see FIG. 3). A rotational axis of the hub body 3 is parallel to the axial direction. The fan blades 4 extend outwardly from the hub body 3. Each of the fan blades 4 includes a first inner end point 41 connected to the hub body 3, a second inner end point 42 connected to the hub body 3 and spaced apart from the first inner end point 41 in the axial direction, a first outer end point 43 located radially and outwardly of the first inner end point 41 and located between the first inner end point 41 and the second inner end point 42 in the axial direction, and a second outer end point 44 located radially and outwardly of the second inner end point 42. Since structures of the fan blades 4 are identical, only one of the fan blades 4 will be described in the following for the sake of brevity. The first outer end point 43 is radially farther away from the hub body 3 than the first inner end point 41, and the second outer end point 44 is radially farther away from the hub body 3 than the second inner end point 42. The first inner end point 41, the second inner end point 42, the first outer end point 43, and the second outer end point 44 cooperatively define a profile of the fan blade 4. The first inner end point 41 is distal from the air outlet 217 in the axial direction relative to the second inner end point 42, and the first outer end point 43 is distal from the air outlet 217 in the axial direction relative to the second outer end point 44. As shown in FIG. 7, a first shortest distance (A) from a top surface of the hub body 3 to the first inner end point 41 in the axial direction is smaller than a second shortest distance (B) from the top surface of the hub body 3 to the first outer end point 43 in the axial direction. As such, the first outer end point 43 is located between the first inner end point 41 and the second inner end point 42 in the axial direction, thereby ensuring performance of the fan blades 4 for radially introducing air therein.

It should be noted that in this embodiment, the axial direction is parallel to an up-down direction. That is to say, the rotational axis of the hub body 3 is disposed in the up-down direction. Referring to FIGS. 3, 4, and 7, by virtue of the design of the first outer end point 43 being located between the first inner end point 41 and the second inner end point 42 in the axial direction, i.e., a position of the first outer end point 43 being lower than that of the first inner end point 41 in the up-down direction, when the hub body 3 drives the fan blades 4 to rotate, air surrounding the composite fan may be effectively and radially introduced into the fan blades 4 from the first outer end point 43 that is lower in position, thereby achieving an effect of enhancing performance of the fan blades 4 for radially introducing air therein. In addition, since the outer cover 22 covers the opening 216 opening in the axial direction, air is radially introduced into the inner space 211 through the air inlets 218 (as indicated by arrows (L1) in FIG. 7) and is pressurized by the fan blades 4 to flow into the air outlet slots 219 (see FIG. 4), and then is discharged via the air outlet 217 (as indicated by an arrow (L2) in FIG. 7), thereby achieving the effect of radially introducing air therein and discharging air in the axial direction. The design of discharging air in the axial direction ensures that a sufficient amount of air is outputted by the composite fan, and the design of radially introducing air into the composite fan may eliminate a reserve space upstream of the composite fan as compared to a conventional axial fan. In practice, an outer surface of the outer cover 22 may be fixed to an inner surface of a housing (not shown) of a device (not shown) to be cooled by the composite fan. Thus, the present disclosure occupies a relatively small volume, and is relatively flexible to be mounted to a device within a relatively constrained space.

In summary, when the air outlet 217 is arranged to open downwardly and thus the first outer end point 43 is lower than the first inner end point 41, the structural design of the present disclosure allows the fan blades 4 to effectively introduce air radially therein. Furthermore, by virtue of the outer cover 22 covering the opening 216 that opens in the axial direction and the air inlets 218 opening radially, the composite fan of the present disclosure may introduce air radially therein and discharge air in the axial direction while providing an advantage of outputting the sufficient amount of air. In addition, since air is introduced radially into the composite fan, it is not required to provide a reserve space upstream of the composite fan for introducing air in the axial direction, and the outer cover 22 may be directly fixed to the housing of the device to be cooled by the composite fan, and thus the composite fan of the present disclosure occupies a relatively small volume and is relatively flexible to be mounted.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A composite fan adapted for radially introducing air therein and discharging air in an axial direction, said composite fan comprising:

an outer frame that includes a main frame body defining an inner space that is in said main frame body, an air outlet that opens in the axial direction and that is in spatial communication with said inner space, and a plurality of air inlets that open radially and that are in spatial communication with said air outlet and said inner space, and an outer cover covering said main frame body, said outer cover and said main frame body being arranged in the axial direction;

a hub body that is pivotably mounted to said outer frame and that is disposed in said inner space, a rotational axis of said hub body being parallel to the axial direction; and a plurality of fan blades that extend outwardly from said hub body, each fan blade including a first inner end point that is connected to said hub body, a second inner end point that is connected to said hub body and that is spaced apart from said first inner end point in the axial direction, a first outer end point that is located radially and outwardly of said first inner end point and that is located between said first inner end point and said second inner end point in the axial direction, and a second outer end point that is located radially and outwardly of said second inner end point, said first inner end point, said second inner end point, said first outer end point, and said second outer end point cooperatively defining a profile of said each fan blade, said first inner end point being distal from said air outlet in the axial direction relative to said second inner end point, said first outer end point being distal from said air outlet in the axial direction relative to said second outer end point.

2. The composite fan as claimed in claim 1, wherein, for each fan blade, a first shortest distance from a top surface of said hub body to said first inner end point in the axial direction is smaller than a second shortest distance from said top surface of said hub body to said first outer end point in the axial direction.

3. The composite fan as claimed in claim 1, wherein said main frame body of said outer frame has an annular frame portion defining an opening that opens in the axial direction, that is spaced apart from said air outlet in the axial direction, and that is in spatial communication with said inner space, a plurality of side pillar portions extending from said annular frame portion in the axial direction, annularly disposed, and angularly spaced apart from each other, and a connecting frame portion connected to said plurality of side pillar portions and defining said air outlet, said outer cover being fixed to said annular frame portion and covering said opening.

4. The composite fan as claimed in claim 3, wherein each air inlet of said outer frame is defined among said annular frame portion, two adjacent ones of said plurality of side pillar portions, and said connecting frame portion.

5. The composite fan as claimed in claim 4, wherein:

said main frame body of said outer frame further has a seat frame portion connected to said connecting frame portion and disposed in said air outlet;

said connecting frame portion divides said air outlet into a plurality of air outlet slots in spatial communication with said inner space; and said hub body is pivotably disposed on said seat frame portion.

* * * * *